US007930877B2

(12) United States Patent
Nardi et al.

(10) Patent No.: US 7,930,877 B2
(45) Date of Patent: Apr. 26, 2011

(54) EXHAUST SYSTEM FOR AN INTERNAL COMBUSTION ENGINE PROVIDED WITH AN EXHAUST GAS RECIRCULATION CIRCUIT

(75) Inventors: Marco Nardi, Venaria (IT); Marco Pidria, Orbassano (IT); Edoardo Merlone Borla, Orbassano (IT)

(73) Assignee: Magneti Marelli Sistemi di Scarico S.p.A., Corbetta (IT)

( * ) Notice: Subject to any disclaimer, the term of this patent is extended or adjusted under 35 U.S.C. 154(b) by 657 days.

(21) Appl. No.: 12/003,001

(22) Filed: Dec. 19, 2007

(65) Prior Publication Data

US 2008/0302091 A1 Dec. 11, 2008

(30) Foreign Application Priority Data

Dec. 21, 2006 (EP) ..... 06425854

(51) Int. Cl.
*F02M 25/06* (2006.01)

(52) U.S. Cl. ..... 60/278; 60/295; 60/297; 60/311; 60/605.2

(58) Field of Classification Search ..... 60/278, 60/280, 295, 297, 311, 605.2
See application file for complete search history.

(56) References Cited

U.S. PATENT DOCUMENTS

| | | | | |
|---|---|---|---|---|
| 5,205,265 | A * | 4/1993 | Kashiyama et al. | 123/568.12 |
| 6,138,649 | A * | 10/2000 | Khair et al. | 123/568.12 |
| 6,625,978 | B1 * | 9/2003 | Eriksson et al. | 60/311 |
| 7,121,081 | B2 * | 10/2006 | Wirkus et al. | 60/282 |
| 7,131,271 | B2 * | 11/2006 | Bulicz et al. | 60/605.2 |
| 7,159,393 | B2 * | 1/2007 | Blomquist et al. | 60/302 |
| 2004/0093866 | A1 * | 5/2004 | Ishikawa | 60/605.2 |
| 2005/0109017 | A1 | 5/2005 | Wirkus et al. | |

FOREIGN PATENT DOCUMENTS

| | | |
|---|---|---|
| GB | 2406138 | 3/2005 |
| WO | WO 98/27323 | 6/1998 |
| WO | WO 03/067044 | 8/2003 |

OTHER PUBLICATIONS

European Search Report mailed May 22, 2007 in European Appln. No. 06425854.4-2311.

* cited by examiner

*Primary Examiner* — Binh Q Tran
(74) *Attorney, Agent, or Firm* — Davidson Berquist Jackson & Gowdey, LLP

(57) ABSTRACT

An exhaust system for an internal combustion engine, which is provided with a feeding pipe of fresh air to an intake manifold and with a turbocharger arranged along the feeding pipe; the exhaust system displays: an emission pipe for releasing the exhaust gases produced by the internal combustion engine into the atmosphere; at least one gas treatment device, which is arranged along the emission pipe and consists of an oxidizing catalyzer and an anti-particulate filter; and a recirculation circuit, which displays a recirculation pipe which is regulated by a recirculation valve and connects the emission pipe downstream of the treatment device to the intake pipe upstream of a compressor of the turbocharger to introduce into the intake pipe a certain amount of exhaust gases present in the emission pipe; along the recirculation pipe a filter consisting of a metallic mesh arranged to close the recirculation pipe is arranged.

24 Claims, 3 Drawing Sheets

EXHAUST SYSTEM FOR AN INTERNAL COMBUSTION ENGINE PROVIDED WITH AN EXHAUST GAS RECIRCULATION CIRCUIT

TECHNICAL FIELD

The present invention relates to an exhaust system for an internal combustion engine provided with an exhaust gas recirculation circuit.

BACKGROUND ART

An internal combustion engine comprises a plurality of cylinders, each of which is connected to an intake manifold by means of at least one corresponding intake valve and to an exhaust manifold by means of at least one corresponding exhaust valve. The intake manifold is connected to a filtering device for receiving fresh air (i.e. air from the outside environment) and is regulated by a butterfly valve, while the exhaust manifold is connected to an exhaust system, which has the function of releasing into the atmosphere gases produced by the internal combustion limiting both the noise and the content of polluting substances.

In an internal combustion engine working according to the "Diesel" cycle (i.e. fed with diesel fuel or the like), to improve the combustion within the cylinders the use of a main recirculation circuit has been suggested, which is regulated by a recirculation valve and connects the exhaust manifold to the intake manifold to introduce into the intake manifold a certain amount of the exhaust gases present in the exhaust manifold and produced by the combustion which previously occurred in the cylinders. In order to not excessively penalise the volumetric efficiency of the engine, before being introduced into the intake manifold, the recirculated exhaust gases may be cooled by a heat exchanger coupled to the main recirculation conduit.

An example of an internal combustion engine provided with a main recirculation circuit of the type described above is described in patent application EP1674698A2 or in patent application DE4240239A1.

In order to reduce the production of NOx during combustion within the cylinders, the use of a secondary recirculation circuit has recently been suggested, which takes a certain amount of the exhaust gases present in the exhaust system downstream of a gas treatment device consisting of a catalyser and an anti-particulate filter. It must be noted that the exhaust gases recirculated by the secondary recirculation circuit display a lower average temperature with respect to the exhaust gases recirculated by the main recirculation system and thus allow to obtain a better cooling of the combustion chambers in the cylinders with a consequent greater reduction of the production of NOx; furthermore, the exhaust gases recirculated by the secondary recirculation system display a much lower content of particulate with respect to the exhaust gases recirculated by the main recirculation circuit and thus have less negative effects on the combustion and on the lubrication within the cylinders.

An example of an internal combustion engine provided with a main recirculation circuit and a secondary recirculation circuit is described in patent application EP1621755A2.

Experimental tests have shown that in an internal combustion engine provided with a main recirculation circuit and a secondary recirculation circuit, the impeller of the turbocharger which compresses the intake air is at high risk of breakage during the first months of operation of the engine. In order to avoid this drawback, the use of reinforced impellers has been suggested, which however display both higher manufacturing costs, and greater mass (i.e. greater mechanical inertia and thus a longer response delay).

DISCLOSURE OF INVENTION

It is the object of the present invention to provide an exhaust system for an internal combustion engine provided with an exhaust gas recirculation circuit, which exhaust system is free from the drawbacks described above and, specifically, is easy and cost-effective to make and allows to preserve the integrity of the impeller of the compressor which compresses the intake air.

According to the present invention, there is provided an exhaust system for an internal combustion engine provided with an exhaust gas recirculation circuit as claimed in the attached claims.

BRIEF DESCRIPTION OF THE DRAWINGS

The present invention will now be described with reference to the accompanying drawings which illustrate a non-limitative example of embodiment thereof, in which.

PREFERRED EMBODIMENTS OF THE INVENTION

Figure 1:
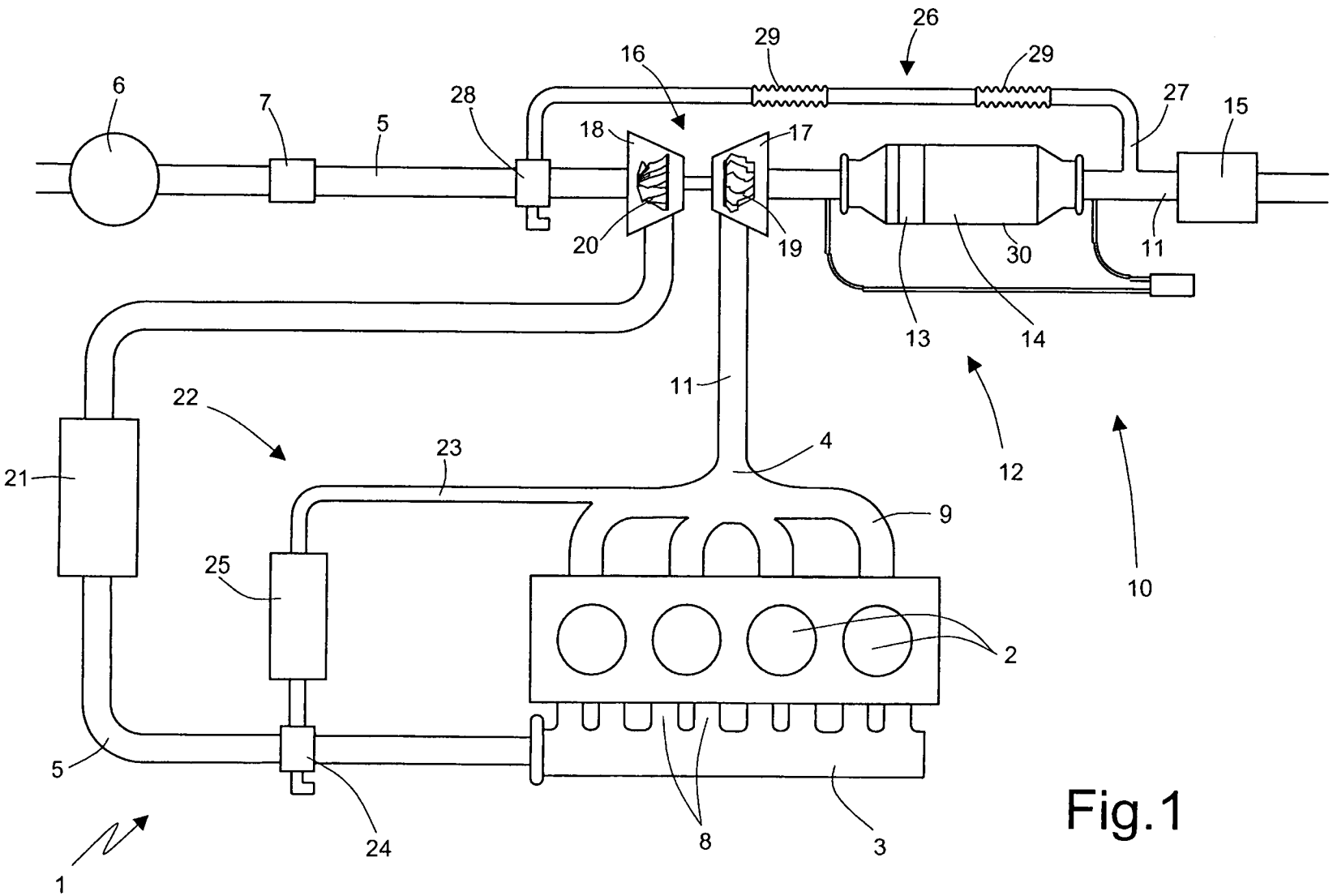
FIG. 1 is a diagrammatic view of an internal combustion engine provided with an exhaust system made according to the present invention.

In FIG. 1, numeral 1 indicates as a whole an internal combustion engine working according to the "Diesel" cycle (i.e. fed with diesel fuel or the like). Engine 1 comprises four cylinders 2, each of which is connected to an intake manifold 3 by means of at least one corresponding intake valve (not shown) and to an exhaust manifold 4 by means of at least one corresponding exhaust valve (not shown).

Intake manifold 3 receives fresh air (i.e. air from the external environment) through an intake pipe 5, which is provided with an air filter 6 and is regulated by a butterfly valve 7; intake manifold 3 is connected to cylinders 2 by means of corresponding intake pipes 8. According to the embodiment shown in FIG. 1, intake pipes 8 are split because they are provided with a choking system of the swirl type.

Similarly, exhaust manifold 4 is connected to cylinders 2 by means of corresponding exhaust pipes 9; an exhaust system 10, which releases the gases produced by the combustion into the atmosphere and comprises an emission pipe 11 provided with a gas treatment device 12 consisting of an oxidising catalyser 13 and an anti-particulate filter 14, is connected to exhaust manifold 4. Anti-particulate filter 14 consists of a refractory material brick, through which the exhaust gas flows and which captures the particulate particles therein; the brick of anti-particulate filter 14 must be cyclically regenerated by increasing the temperature of the brick so as to burn the particulate particles captured inside the brick. Exhaust system 10 further comprises at least one muffler 15, which is connected downstream of treatment device 12.

Engine 1 comprises a turbocharger 16, which has the function of compressing air along intake pipe 5 so as to increase the volumetric efficiency. Specifically, turbocharger 16 comprises a turbine 17 arranged along emission pipe 11 upstream of the treatment device 12 and a compressor 18 arranged downstream of intake pipe 3 of butterfly valve 7. Turbine 17 comprises an impeller 19, which is induced to revolve by the exhaust gases which flow through emission pipe 11 and is mechanically connected to an impeller 20 of compressor 18 so as to transmit the revolution motion to impeller 20.

A heat exchanger 21 (commonly named "intercooler"), which has the function of cooling the intake air to further increase volumetric efficiency, is arranged along intake pipe 5 and between compressor 18 and intake manifold 3.

Engine 1 comprises a recirculation circuit 22, which comprises a recirculation pipe 23 which is regulated by a recirculation valve 24 and connects exhaust pipe 4 to feeding pipe 5 immediately upstream of intake manifold 3 to introduce a certain amount of exhaust gases present in exhaust manifold 4 and produced by the combustion which previously occurred in cylinders 2 into feeding manifold 5. Preferably, recirculation valve 24 is arranged at the confluence with feeding pipe 5; specifically, recirculation valve 24 is arranged along feeding pipe 5 at the confluence with recirculation pipe 23. In order to not excessively penalise the volumetric efficiency of the engine, before being introduced into intake manifold 3, the recirculated exhaust gases are cooled by a heat exchanger 25 arrange along recirculation pipe 23.

Moreover, there is provided a further recirculation circuit 26, which comprises a recirculation pipe 27 which is regulated by a recirculation valve 28 and connects emission pipe 11 downstream of treatment device 12 to intake pipe 5 upstream of compressor 18 of turbocharger 16 to introduce into intake pipe 5 a certain amount of exhaust gases present in emission pipe 11 and produced by the combustion which previously occurred in cylinders 2. Preferably, recirculation valve 28 is arranged at the confluence with feeding pipe 5; specifically, recirculation valve 28 is arranged along feeding pipe 5 at the confluence with recirculation pipe 27. In order not to excessively penalise the volumetric efficiency of the engine, before being introduced into intake pipe 5, the recirculated exhaust gases are cooled by at least one heat exchanger 29 arranged along recirculation pipe 27.

Figure 2:
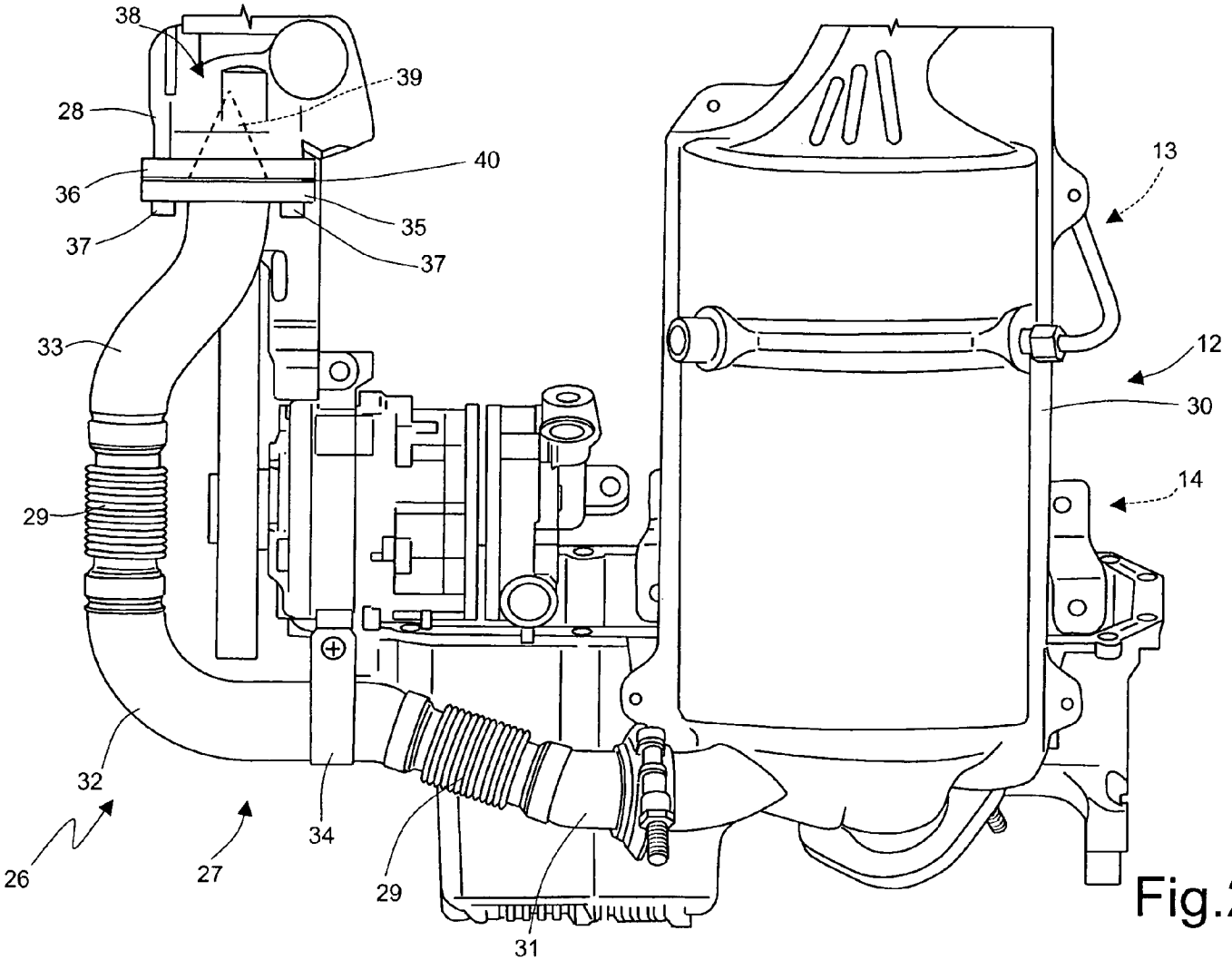
FIG. 2 is a diagrammatic view of a recirculation system of the exhaust system in FIG. 1.

As shown in FIG. 2, treatment device 12 comprises a metallic tubular support body 30, within which oxidising catalyser 13 and anti-particulate filter 14 are arranged in series. Preferably, within tubular support body 30, oxidising catalyser 13 is distanced from anti-particulate filter 14 so as to define an empty space between oxidising catalyser 13 and anti-particulate filter 14.

According to the embodiment shown in FIG. 2, recirculation circuit 26 comprises a pair of heat exchangers 29 arranged along recirculation pipe 27, each of which is of the air-air type and consists of a tubular element having a bellow-shaped side surface (in this manner, the thermal exchange surface may be up to five times higher with respect to a smooth tubular element). Furthermore, in virtue of its conformation, each heat exchanger 29 may absorb thermal dilatations without any problem.

Recirculation pipe 27 consists of three tubes 31, 32 and 33, between which the two heat exchangers 29 are interposed; specifically, there are provided a first tube 31 rigidly connected to a port of treatment device 12, an intermediate tube 32 displaying a 90° curve and fixed to an element of internal combustion engine 1 by means of a tube clamp 34, and a terminal tube 33 displaying an "S"-shape and rigidly connected to a port of recirculation valve 28.

Figure 3:
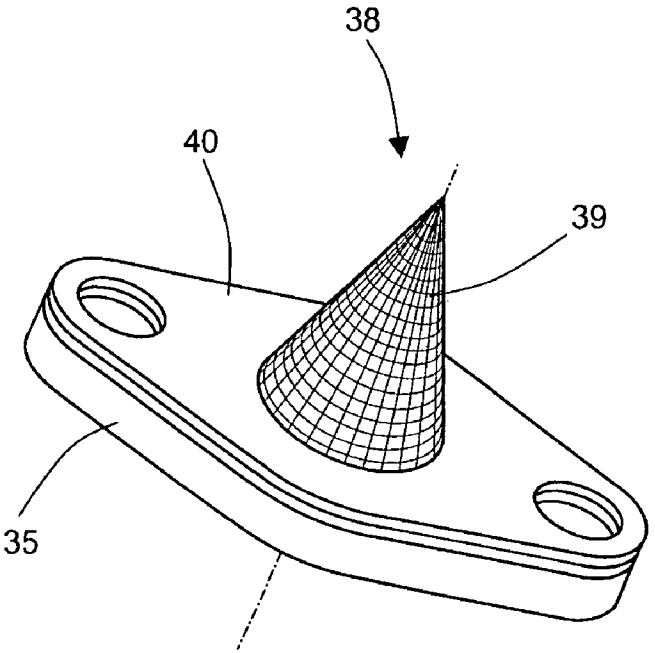
FIG. 3 is a perspective view of a filter of the recirculation circuit in FIG. 1.

Specifically, terminal tube 33 is fixed to the port of recirculation valve 28 by means of a connection flange 35, which is fixed onto a corresponding connection flange 36 of recirculation valve 28 by means of a pair of screws 37 and supports a filter 38 arranged along recirculation pipe 27. As shown in FIG. 3, filter 38 comprises a metallic mesh 39 arranged to close recirculation pipe 27. According to the embodiment shown in the accompanying figures, metallic mesh 39 of filter 38 displays a conical shape (preferably having the tip oriented towards feeding pipe 5); according to a different embodiment (not shown), metallic mesh 39 of filter 38 is flat (this solution is constructively simpler and more cost-effective but on the other hand displays a smaller filtering surface).

Metallic mesh 39 of filter 38 displays meshes with regular openings having a maximum size smaller than 180 μm; preferably, metallic mesh 39 of filter 38 displays meshes with regular openings having a size in the range between 120 μm and 160 μm.

Figure 4:
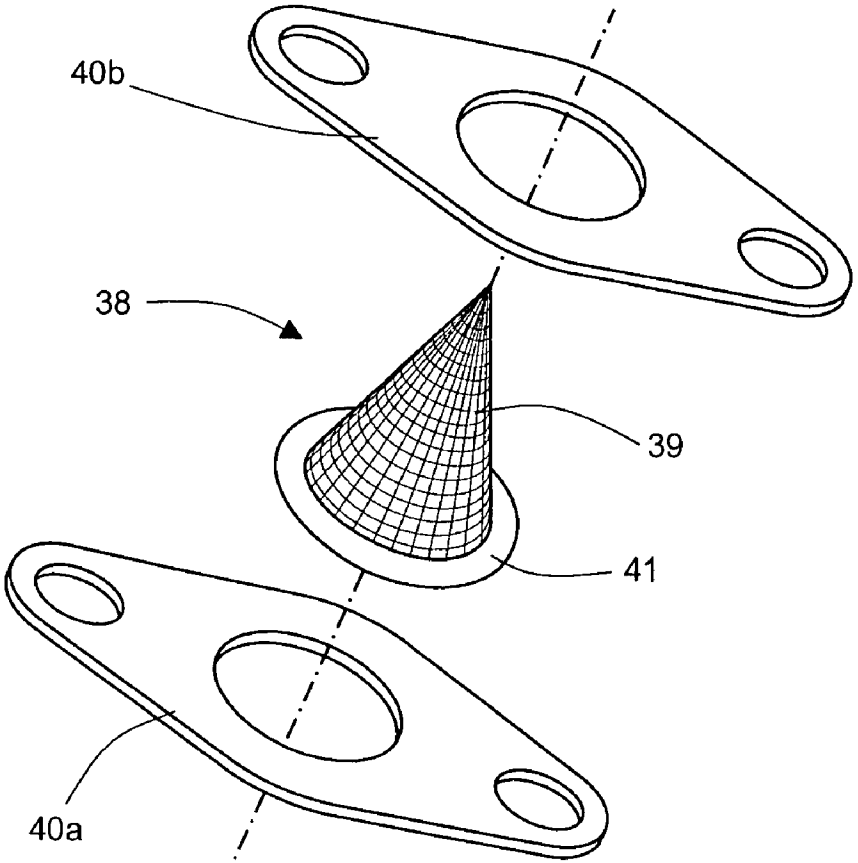
FIG. 4 is an exploded perspective view of the filter in FIG. 4.

According to the embodiment shown in FIGS. 3 and 4, metallic mesh 39 of filter 38 is integrated in a seal 40 which is interposed between connection flange 35 and recirculation valve 28. Specifically, metallic mesh 39 of filter 38 displays a flat edge 41 which is enclosed between two halves 40*a* and 40*b* of seal 40 which are connected to each other.

Exhaust system 10 described above displays a number of advantages, because it is simple and cost-effective to make and at same time allows to preserve the integrity of impeller 20 of compressor 18 which compresses the intake air without penalising, at the same time, the performance of recirculation circuit 26. This result is obtained in virtue of the presence of filter 38, which on one side does not determine significant load loss in recirculation circuit 26 and on the other side avoids that fragments which are detached from anti-particulate filter 14 during the first months of life of anti-particulate filter 14 (or other solid particles present in exhaust system 10) come into contact with impeller 20 of compressor 18 which compresses the intake air. Indeed, it has been observed that during the first months of life of anti-particulate filter 14, fragments of size larger than 200 μm may detach from anti-particulate filter 14, which may cause damage to impeller 20 of compressor 18 which comprises the intake air.

Filter 38 described above allows to preserve the integrity of impeller 20 of compressor 18 which compresses the intake air in a simple, extremely cost-effective manner and above all without penalising the performance of recirculation circuit 26. Furthermore, filter 38 described above is capable of containing all of the fragments potentially released by anti-particulate filter 14 during the first months of life without getting excessively obstructed, thus without requiring any cleaning or replacement intervention.

The invention claimed is:

1. An exhaust system (10) for an internal combustion engine (11), which is provided with a intake pipe (5) of fresh air to an intake manifold (3) and with a turbocharger (16) arranged along the intake pipe (5); the exhaust system (10) comprises:

an emission pipe (11) for releasing the exhaust gases produced by the internal combustion engine (1) into the atmosphere;

at least one gas treatment device (12), which is arranged along the emission pipe (11) and consists of an oxidizing catalyzer (13) and an anti-particulate filter (14); and a recirculation circuit (26), which comprises a recirculation pipe (27) which is regulated by a recirculation valve (28) arranged at the confluence with the intake pipe (5) and connects the emission pipe (11) downstream of the treatment device (12) to the intake pipe (5) upstream of a compressor (18) of the turbocharger (16) to introduce into the intake pipe (5) a certain amount of exhaust gases present in the emission pipe (11);

wherein the recirculation circuit (26) further comprises a filter (38), which is arranged along the recirculation pipe (27) near the confluence with the intake pipe (5) and comprises a metallic mesh (39);

wherein a tube of the recirculation pipe (27) ends with a connection flange (35), which is fixed onto the recirculation valve (28) and supports the filter (38); and wherein the metallic mesh (39) of the filter (38) is integrated in a seal (40) which is interposed between the connection flange (35) and the recirculation valve (28).

2. An exhaust system (10) according to claim 1, wherein the recirculation valve (28) is arranged along the intake feeding pipe (5) at the confluence with the recirculation pipe (27).

3. An exhaust system (10) according to claim 1, wherein the metallic mesh (39) of the filter (38) displays a flat edge (41) which is enclosed between two halves (40*a*, 40*b*) of a seal (40) which are connected to each other.

4. An exhaust system (10) according to claim 1, wherein the metallic mesh (39) of the filter (38) is flat.

5. An exhaust system (10) according to claim 1, wherein the metallic mesh (39) of the filter (38) displays a conical shape.

6. An exhaust system (10) according to claim 5, wherein the metallic mesh (39) of the filter (38) displays a conical shape having the tip oriented towards the intake feeding pipe (5).

7. An exhaust system (10) according to claim 1, wherein the metallic mesh (39) of the filter (38) displays meshes with regular openings having a maximum size smaller than 180 μm.

8. An exhaust system (10) according to claim 7, wherein the metallic mesh (39) of the filter (38) displays meshes with regular openings having a maximum size smaller than 160 μm.

9. An exhaust system (10) according to claim 8, wherein the metallic mesh (39) of the filter (38) displays meshes with regular openings having a size in the range between 120 μm and 160 μm.

10. An exhaust system (10) according to claim 1, wherein the recirculation circuit (26) comprises at least one heat exchanger (29) arranged along the recirculation pipe (27).

11. An exhaust system (10) according to claim 10, wherein the recirculation circuit (26) comprises a pair of heat exchangers (29) arranged along the recirculation pipe (27).

12. An exhaust system (10) according to claim 11, wherein the recirculation pipe (27) consists of three tubes (31, 32, 33), between which the two heat exchangers (29) are interposed; there are provided a first tube (31) rigidly connected to a port of treatment device (12), an intermediate tube (32) displaying a 900 curve and fixed to an element of the internal combustion engine (1) by means of a tube clamp (34), and a terminal tube (33) displaying an "S"-shape and rigidly connected to a port of the recirculation valve (28).

13. An exhaust system (10) according to claim 10, wherein each heat exchanger (29) is of the air-air type and consists of a tubular element having a bellow-shaped side surface.

14. An exhaust system (10) according to claim 1, wherein the treatment device (12) comprises a same tubular support body (30), within which oxidizing catalyzer (13) and anti-particulate filter (14) are arranged in series.

15. An exhaust system according to claim 14, wherein inside the tubular support body (30), the oxidizing oxidizing catalyzer (13) is distanced from the anti-particulate filter (14) so as to define an empty space between the oxidizing oxidizing catalyzer (13) and the anti-particulate filter (14).

16. An exhaust system for an internal combustion engine, which is provided with a intake pipe of fresh air to an intake manifold and with a turbocharger arranged along the intake pipe; the exhaust system comprises:

an emission pipe for releasing the exhaust gases produced by the internal combustion engine into the atmosphere;

at least one gas treatment device (12), which is arranged along the emission pipe and consists of an oxidizing catalyzer and an anti-particulate filter; and a recirculation circuit, which comprises a recirculation pipe which is regulated by a recirculation valve and connects the emission pipe downstream of the treatment device to the intake pipe upstream of a compressor of the turbocharger to introduce into the intake pipe a certain amount of exhaust gases present in the emission pipe;

wherein the recirculation circuit comprises a filter, which is arranged along the recirculation pipe and comprises a metallic mesh arranged to close the recirculation pipe, and a pair of heat exchangers arranged along the recirculation pipe; and wherein the recirculation pipe consists of three tubes, between which the two heat exchangers are interposed; there are provided a first tube rigidly connected to a port of treatment device, an intermediate tube displaying a 90° curve and fixed to an element of the internal combustion engine by means of a tube clamp, and a terminal tube displaying an "S"-shape and rigidly connected to a port of the recirculation valve.

17. An exhaust system according to claim 16, wherein each heat exchanger is of the air-air type and consists of a tubular element having a bellow-shaped side surface.

18. An exhaust system for an internal combustion engine, which is provided with a intake pipe of fresh air to an intake manifold and with a turbocharger arranged along the intake pipe; the exhaust system comprises:

an emission pipe for releasing the exhaust gases produced by the internal combustion engine into the atmosphere;

at least one gas treatment device, which is arranged along the emission pipe and consists of an oxidizing catalyzer and an anti-particulate filter; and a recirculation circuit, which comprises a recirculation pipe which is regulated by a recirculation valve arranged at the confluence with the intake pipe and connects the emission pipe downstream of the treatment device to the intake pipe upstream of a compressor of the turbocharger to introduce into the intake pipe a certain amount of exhaust gases present in the emission pipe;

wherein the recirculation circuit comprises a filter, which is arranged along the recirculation pipe near the confluence with the intake pipe and comprises a metallic mesh arranged to close the recirculation pipe;

wherein a tube of the recirculation pipe ends with a connection flange, which is fixed onto the recirculation valve and supports the filter; and wherein the metallic mesh of the filter displays a flat edge which touches a seal and together with the seal is enclosed between the connection flange of the recirculation pipe and a connection flange of the recirculation valve.

19. An exhaust system according to claim 18, wherein the metallic mesh (39) of the filter (38) is flat.

20. An exhaust system according to claim 18, wherein the metallic mesh of the filter displays a conical shape.

21. An exhaust system according to claim 20, wherein the metallic mesh of the filter displays a conical shape having the tip oriented towards the intake pipe.

22. An exhaust system according to claim 18, wherein the metallic mesh of the filter displays meshes with regular openings having a maximum size smaller than 180 μm.

23. An exhaust system according to claim 22, wherein the metallic mesh f the filter displays meshes with regular openings having a maximum size smaller than 160 μm.

24. An exhaust system according to claim 23, wherein the metallic mesh of the filter displays meshes with regular openings having a size in the range between 120 μm and 160 μm.

* * * * *